United States Patent [19]

Saito et al.

[11] 4,019,054

[45] Apr. 19, 1977

[54] APPARATUS FOR FIXING TONER IMAGES

[75] Inventors: Kinzi Saito, Kawasaki; Sadao Takahashi, Tokyo, both of Japan

[73] Assignee: Richo Company, Ltd., Japan

[22] Filed: July 21, 1975

[21] Appl. No.: 597,692

[30] Foreign Application Priority Data

July 19, 1974 Japan ..... 49-82940
May 7, 1975 Japan ..... 50-54827

[52] U.S. Cl. ..... 250/319; 250/316
[51] Int. Cl.[2] ..... G03C 5/16
[58] Field of Search ..... 250/319, 316, 495, 504

[56] References Cited

UNITED STATES PATENTS

| | | | |
|---|---|---|---|
| 1,715,634 | 6/1929 | Barrett | 250/504 |
| 2,275,745 | 3/1942 | Eastman | 250/504 |
| 2,551,319 | 5/1951 | Eiklid | 250/495 |
| 3,405,265 | 10/1968 | Vrancken | 250/319 |
| 3,419,709 | 12/1968 | Bell | 250/504 |
| 3,452,181 | 6/1969 | Stryjewski | 250/319 |

*Primary Examiner*—Alfred E. Smith
*Assistant Examiner*—B. C. Anderson
*Attorney, Agent, or Firm*—McGlew and Tuttle

[57] ABSTRACT

An apparatus for fixing toner images in which a radiating member is interposed between a near infrared red ray source and a path of movement of a support sheet bearing a toner image for producing far infrared rays. The radiating member is constructed with metal foils such that the foils form a large number of complicated paths for the near infrared rays from said source so that the rays are converted into heat after infinite repeated reflection. Air is sprayed through the complicated paths toward the sheet path to improve the fixing efficiency by an atmospheric heating in addition to the far infrared heating and further to prevent a combustion of the sheet in the event it is jammed.

6 Claims, 5 Drawing Figures

APPARATUS FOR FIXING TONER IMAGES

BACKGROUND OF THE INVENTION

The invention relates to an apparatus for fixing a toner image on a support therefor such as a recording sheet.

The wavelength of an infrared ray which gives the best percent absorption by a white paper is 3 $\mu$m or higher, and a substance radiating an infrared ray with a peak in such region has a color temperature which is around 1000° K. In the electrophotographic copying, a heating lamp having a wattage of about 1000 W which produces a color temperature of 2000° K is usually employed in consideration of the rising rate of thermal radiation and the size of the heat source used. When such heating lamps is used and a recording sheet is passed with a speed of 8 cm/sec, the sheet may be scorched in those image portions having a substantial area, while an insufficient fixing results in line image portions.

There has been known a proposal in which a light shield member comprising a flat aluminium plate is disposed in front of an infrared lamp, and an image carrying member is passed along the light shield member in order to permit a fusion of a toner image by heating it with secondary radiation from the shield member. However, the thermal efficiency of such apparatus is not considered to be favorable because of the interposition of the secondary radiating member for direct heating of the image carrying member. In addition, where the image carrying member comes to a halt as by a failure of a conveying machine, there is a likelihood of producing a fire as a result of overheated recording sheet.

SUMMARY OF THE INVENTION

It is an object of the invention to provide an apparatus which achieves a satisfactory thermal fusion of a toner image by utilizing a primary radiation from a source of infrared ray and a secondary radiation which is obtained by shielding a portion of the primary radiation.

It is another object of the invention to provide an apparatus for thermal fusion which uses as a secondary radiating body, a radiating body having a very low heat capacity and configured to physically behave as a black body for at least portion of an infrared ray applied thereto, and which utilizes ventilation for environmental heating and for preventing a recording sheet from being overheated.

DETAILED DESCRIPTION OF EMBODIMENTS

Figure 1:
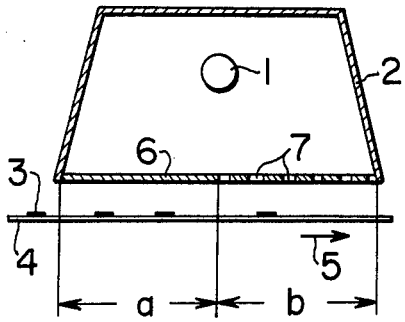
FIG. 1 is an elevational section of the thermal fusion apparatus constructed in accordance with one embodiment of the invention.

Referring to FIG. 1, there is shown a heating lamp 1 which emits an infrared ray and which is disposed inside a reflecting mirror 2. A recording sheet 4 carrying toner images 3 to be fixed is conveyed in a direction indicated by an arrow 5 so as to pass by the lamp 1. A secondary radiating body 6 which comprises a sheet of metal is disposed between the lamp 1 and the recording sheet 4, or across the opening of the reflecting mirror 2. Over its one-half length indicated by a region *a* which is located near the inlet end, the radiating body 6 remains solid while it is formed with a plurality of windows 7 in the remaining region *b* which is located nearer the discharge end of the recording sheet 4. Each of the windows may comprise a slit extending crosswise of the recording sheet 4 or plurality of small apertures. The inner surface of the radiating body 6 inclusive of the window region is electroplated to a black color or otherwise blackened to achieve a good absorption of an infrared ray. The arrangement is such that the radiating body achieves a temperature on the order of about 500° C so that a fixing of a toner image with the far infrared ray emitted by the radiating body 6 alone results in a generally insufficient fixing, even though differential degrees of fixing depending on the area of image portions are reduced.

To fix the toner image 3 on the recording sheet 4, it is necessary that the temperature of the sheet 4 be raised to a certain level. At this end, the sheet 4 which is made to have an increased absorptive power for the far infrared ray is pre-heated by the radiating body 6 in the first region *a*, and during the passage through the second region *b*, the toner image 3 is more efficiently heated by the near infrared ray from the lamp 1 which is transmitted through the windows, thus completing a fixing.

In the second region *b*, it is desirable that 1/10 to 7/10 of the material of the radiating body 6 is removed by forming the windows 7. Most preferably, the windows 7 assume a proportion of from 2/10 to 4/10 of the area of the radiating body 6 for direct passage of thermal radiation, which assures a complete fixing without influence by the configuration of the various image areas.

Figure 2:
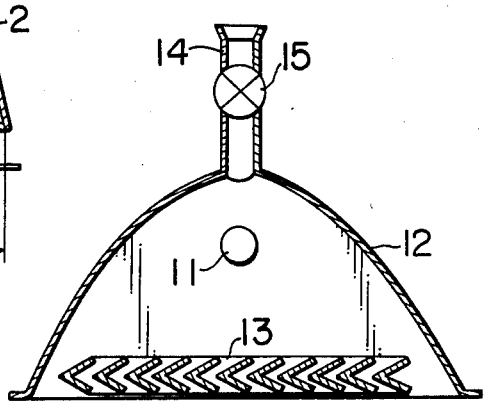
FIG. 2 is an elevational section of another embodiment.

FIG. 2 shows another embodiment of the invention in which a source of infrared ray 11 such as a well-known infrared lamp is disposed at the focus of a parabolic reflector 12 which has a parabolic profile in section, surrounds the source 11 and is open at its lower end. The reflector has a mirror finish, inner surface for uniformly projecting the infrared ray radiated from the source 11 toward the plane of the opening.

The opening of the reflector is covered by a radiating body or member 13 which comprises a plurality of rows of metal plates arranged in the manner of blinds, thus forcing a radiation shielding space. The radiating body 13 may be formed by using sheets of stainless steel or copper, which have a low heat capacity. More preferably, the radiating body 13 comprises a plate means sheet materials having a low heat capacity and a good temperature and acid resistance such as nickel sheets, or copper sheets plated with nickel or silver. In this manner, the radiating body 13 is made so as to be rapidly heated. Although a portion of the infrared ray applied to the radiating body 13 may transmit therethrough after a finite repeated reflection, in view of its configuration, the radiating body 13 physically behaves like a black body for the remaining major portion of the infrared ray because of infinite repeated reflection of the ray introduced, thus achieving a cavity radiation response. Specifically, the upper surface of the radiating body 13 efficiently absorbes the near infrared ray which is uniformly projected thereto, while it efficiently radiates the far infrared ray to the image which passes adjacent to its lower surface, thus performing an efficient secondary radiating function.

A port 14 communicating with the outer atmosphere is formed in the top of the reflector 12, and a fan 15 draws the outer atmosphere through the port 14 and delivers it into the internal space within the reflector 12, the air being ultimately diverted through the radiating body 13 and sprayed downwardly from the lower surface thereof. Such air current cools down the source 11 to prevent its overheating, and the hot air sprayed from the lower surface of the radiating body 13 contacts the images for heating them, thus improving the fixing efficiency by an atmospheric heating added with the heating of the images by the secondary radiation. Additionally, the sprayed air current prevents a combustion of the image carrying sheet, by dissipating the heat thereof in the event it is jammed. It also serves diffusion toxious and/or combustible gases which may be evolved during the heating of the image, thus avoiding hazardous results.

Figure 3:
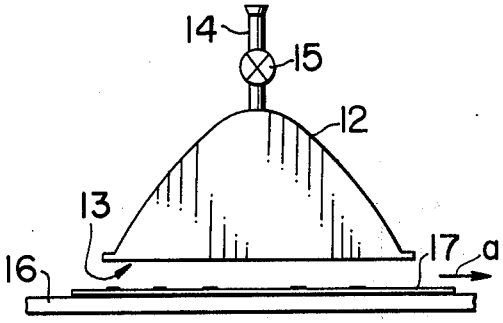
FIG. 3 is a front view of the embodiment shown in FIG. 2.

The present thermal fusion apparatus can be used for fixing in the similar manner as with a conventional apparatus, by placing an image carrying member 17 such as photosensitive paper on a conveying member 16 such as belt for movement across the lower surface of the radiating body 13 in spaced relationship therewith in the direction of an arrow a, as generally shown in FIG. 3, thereby allowing a toner resin which forms the image to be thermally fused onto the member 17 during its movement.

Figure 4:
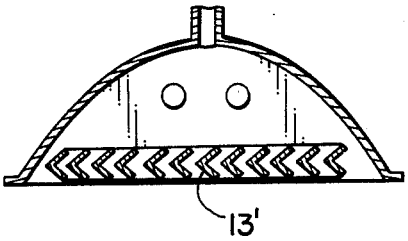
FIG. 4 is an elevational section of the thermal fusion apparatus showing a modification of the embodiment shown in FIG. 2.
Figure 5:
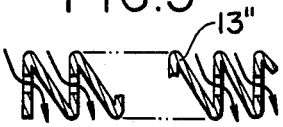
FIG. 5 is a schematic view showing another configuration of the radiating body.

While in the above illustration, a single source of infrared ray has been used, it will be appreciated that the number of such sources may be chosen as desired. Where a pair of infared lamps are used, they may be arranged to that the focus of the reflector is located at the median between them, as illustrated in FIG. 4. Also the configuration of the radiation body 13' is not limited to the form of blinds illustrated, but any configuration which can provide the cavity radiation response be used with similar effect. By way of example, a body 13'' may be formed as bellows as illustrated in FIG. 5.

To summarize, the apparatus according to the invention achieves the following advantages;

1. Increased thermal efficiency and fixing efficiency allow the capacity of the heat source to be reduced, and hence permit a compact structure.
2. Rapid temperature rise facilitates the control.
3. Risk of the sheet inflaming is avoided, and the durability of the heating element is improvided.
4. Pollution of air within the operating environment is prevented.
5. The radiating body is inexpensively manufactured in view of its simple configuration.
6. The apparatus is not limited to use in the electrophotography, but is generally applicable as a heater.

What is claimed is:

1. An apparatus for fixing toner images on a sheet bearing such images, comprising means for feeding the image-bearing sheets along a feed path, a housing overlying such feed path, an infrared light source in said housing; and light ray directing means between said light source and said feed path for directing the light from said source in a path to produce a first high temperature region along an initial portion of said feed path and a second high temperature region having temperature higher than said first high temperature region along the remaining portion of said path, said light ray directing means including a solid portion of said housing defined along the length of said feed path to produce the first high temperature region and a perforated portion extending along the remainder of the feed path defining the second high temperature region.

2. An apparatus for fixing toner images comprising infrared source means for radiating near infrared rays, conveyor means spaced from and facing said infrared source means for conveying a support sheet bearing a toner image on its surface, a radiating member interposed between said source means and said conveyor means for absorbing a first portion of said near infrared rays, said radiating member being heated by said portion and radiation far infrared rays to said support sheet, said radiating member being in the form of plate means defining a plurality of tortuous paths between said source and said conveyor means for allowing a second portion of said near infrared rays to transmit from said source through said plates to said support sheet.

3. An apparatus according to claim 2, wherein said plate means further comprise a plurality of spaced substantially parallel angled plates.

4. An apparatus according to claim 2, wherein said plate means further comprises a continuous bellows having perforations for transmitting the second portion of near infrared rays.

5. An apparatus according to claim 2, including a reflector encasing said source means for directing said near infrared rays toward said radiating member and having an input port for admitting air, and an output port partially covered by said radiating member for allowing the air to leave said reflector and a fan in said reflector for moving the air from said input port past said radiating member and toward said conveyor means.

6. An apparatus for fixing toner images comprising infrared source means for radiating near infrared rays, conveyor means spaced from and facing said source means for conveying a support sheet bearing a toner image on its surface, a perforated member between said source means and said conveyor means for absorbing a first portion of said near infrared rays to heat said member and cause it to radiate far infrared rays toward said conveyor means and said perforations forming a path between said source and said conveyor means so that a second portion of said near infrared rays can radiate directly toward said conveyor means.

* * * * *